US006124555A

United States Patent [19]

Isikawa

[11] Patent Number: 6,124,555

[45] **Date of Patent: *Sep. 26, 2000**

[54] MULTIPLE-OPERATION ELECTRIC COMPONENT

[75] Inventor: Sinzi Isikawa, Miyagi-ken, Japan

[73] Assignee: Alps Electric Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/137,995

[22] Filed: Aug. 21, 1998

[30] Foreign Application Priority Data

Aug. 22, 1997 [JP] Japan ..... 9-226811

[51] Int. Cl.[7] ..... H01H 25/04

[52] U.S. Cl. ..... 200/4; 200/5 R; 200/18; 200/6 A

[58] Field of Search ..... 200/5 A, 5 R, 200/7, 61.27, 4, 186 A, 6 R; 273/148 B

[56] References Cited

U.S. PATENT DOCUMENTS

| | | | |
|---|---|---|---|
| 3,919,506 | 11/1975 | Kellogg | 200/16 R |
| 3,931,606 | 1/1976 | Oka et al. . | |
| 4,245,137 | 1/1981 | Hirai et al. | 200/4 |
| 4,330,694 | 5/1982 | Ogawa | 200/6 A |
| 4,414,438 | 11/1983 | Maier et al. | 200/18 X |
| 4,758,692 | 7/1988 | Roeser et al. | 200/6 A |
| 4,763,100 | 8/1988 | Wood . | |
| 4,784,008 | 11/1988 | Paquereau et al. | 74/471 XY |
| 4,816,662 | 3/1989 | Kyoden | 200/5 R |
| 5,151,563 | 9/1992 | Tanaka | 200/6 A |
| 5,430,265 | 7/1995 | Beattie et al. | 200/61.54 |
| 5,459,292 | 10/1995 | Nagano et al. | 200/5 R |
| 5,665,946 | 9/1997 | Nishijima et al. | 200/4 |
| 5,744,765 | 4/1998 | Yamamoto | 200/6 A |
| 5,780,794 | 7/1998 | Uchiyama et al. | 200/61.54 |

FOREIGN PATENT DOCUMENTS

| | | |
|---|---|---|
| 1163428 | 2/1964 | Germany . |
| 35 24 439 A1 | 1/1987 | Germany . |
| 64-11503 | 1/1989 | Japan . |

*Primary Examiner*—Renee Luebke
*Attorney, Agent, or Firm*—Brinks Hofer Gilson & Lione

[57] ABSTRACT

Disclosed is a multiple-operation electric component in which a rotary electric component is incorporated on the outside of a multi-direction switch, and which is suitable for a reduction in height. In the multiple-operation electric component, a driver having a second movable contact plate as an engagement member is spline-connected to an operating lever of the multi-direction switch, and a plurality of projections are formed on the outer periphery of the second movable contact plate at predetermined intervals. An operating ring of a rotary switch is rotatably arranged on the outside of the operating lever, and a plurality of cutouts are formed on the inner peripheral surface of the operating ring. The projections of the second movable contact plate are inserted into the corresponding cutouts of the operating ring so that the rotation of the operating lever is transmitted to the operating ring through engagement portions of the projections with the cutouts, and that the projections are rotated within the cutouts during tilting of the operating lever, whereby the tilting of the operating lever is not prevented by the operating ring.

1 Claim, 5 Drawing Sheets

MULTIPLE-OPERATION ELECTRIC COMPONENT

BACKGROUND OF THE INVENTION

1. Field of the Invention

The present invention relates to a multiple-operation electric component having the dual function of a rotary electric component, such as a rotary switch, a rotary volume control and the like, and of a multi-direction switch.

2. Description of the Related Art

Hitherto, as disclosed in Japanese Unexamined Utility Model Publication No. 64-11503, a multiple-operation electric component has been proposed and used. In such a multiple-operation electric component, a multi-direction switch for selectively actuating four push-button switches in response to tilting an operating lever, and a rotary volume control actuated by rotating the operating lever are integrally incorporated.

The multiple-operation electric component includes an operating lever tiltably and pressably held, four push-button switches arranged on the upper surface of a base plate at angular intervals of 90° and a rotary volume control arranged on the lower surface of the base plate. By tilting the operating lever in an arbitrary direction, one of four push-button switches is selectively actuated and position-detecting signals are output in four directions in response to the tilting of the operating lever. In addition, bevel gears are mounted at the lower end of the operating lever and to a rotating shaft of the rotary volume control. By rotating the operating lever while pressing, both bevel gears are meshed with each other so that a rotating force of the operating lever is transmitted to the rotary volume control, whereby a continuous signal responsive to the rotation of the operating lever is output from the rotary volume control.

The above-described conventional multiple-operation electric component, however, includes push-button switches arranged on the upper surface of the base plate and the rotary volume control arranged on the lower surface of the base plate, and the rotating shaft is actuated by the operating lever that passes through the base plate to project downward. Therefore, components of the multi-direction switch and the rotary volume control are disposed above and below the base plate, so that the height of the multiple-operation electric component increases. In addition, when the rotating force of the operating lever is transmitted to the rotary volume control, the operating lever is required to be rotated when the operating lever is pressed to mesh both the bevel gears with each other, so that ease of operation when actuating the rotary volume control deteriorates.

SUMMARY OF THE INVENTION

Accordingly, it is an object of the present invention to provide a multiple-operation electric component in which a rotary electric component is incorporated on the outside of a multi-direction switch, and which is suitable for a reduction in height.

According to an aspect of the present invention, there is provided a multiple-operation electric component which generates an output signal in response to tilting of an rotary electric component which generates an output signal in response rotation of the operating lever arranged on the outside of the multi-direction switch; and an engagement member provided between the operating lever and the operating ring, wherein the engagement member is operated in association with the tilting and the rotation of the operating lever, and the engagement member and the operating ring are allowed to transmit force only in the direction of rotation of the operating lever.

With the above arrangements, the rotary electric component can be coaxially arranged on the outside of the multi-direction switch, so that the thickness of the multiple-operation electric component can be reduced.

An electric component having a rotatable operating ring, such as a rotary switch and a rotary volume control, may be used as the above rotary electric component, and the rotation of the operating ring may be limited within an angle of 360°, or may not be limited.

The engagement member and the operating ring are spline connected for example, a plurality of cutouts may be formed on the inner peripheral surface of the operating ring at predetermined intervals, and a plurality of projections may be inserted into the cutouts. Conversely, projections formed on the inner peripheral surface of the operating ring may be inserted into cutouts formed on the outer peripheral surface of the engagement member.

In addition, the engagement portion of the engagement member with the operating ring may be located on a plane including a fulcrum of the operating lever. With this arrangement, the amount of movement of the engagement member that is tilted in association with the tilting of the operating lever is reduced, so that the size of the portion that engages the engagement member with the operating ring can be reduced in size.

Further, the engagement member and the operating lever may be formed by separate members and spline-connected so as to generate an output a signal in response to pushing of the operating lever. With this arrangement, the engagement member is not moved when the operating lever is pushed, and only the operating lever is moved downward, so that the operating lever can be pushed by a light force.

DESCRIPTION OF THE PREFERRED EMBODIMENT

A multiple-operation electric component according to an embodiment of the present invention consists of an inner multi-direction switch and an outer rotary switch, and the multi-direction switch and the rotary switch are combined in one piece, as described later.

Figure 1:
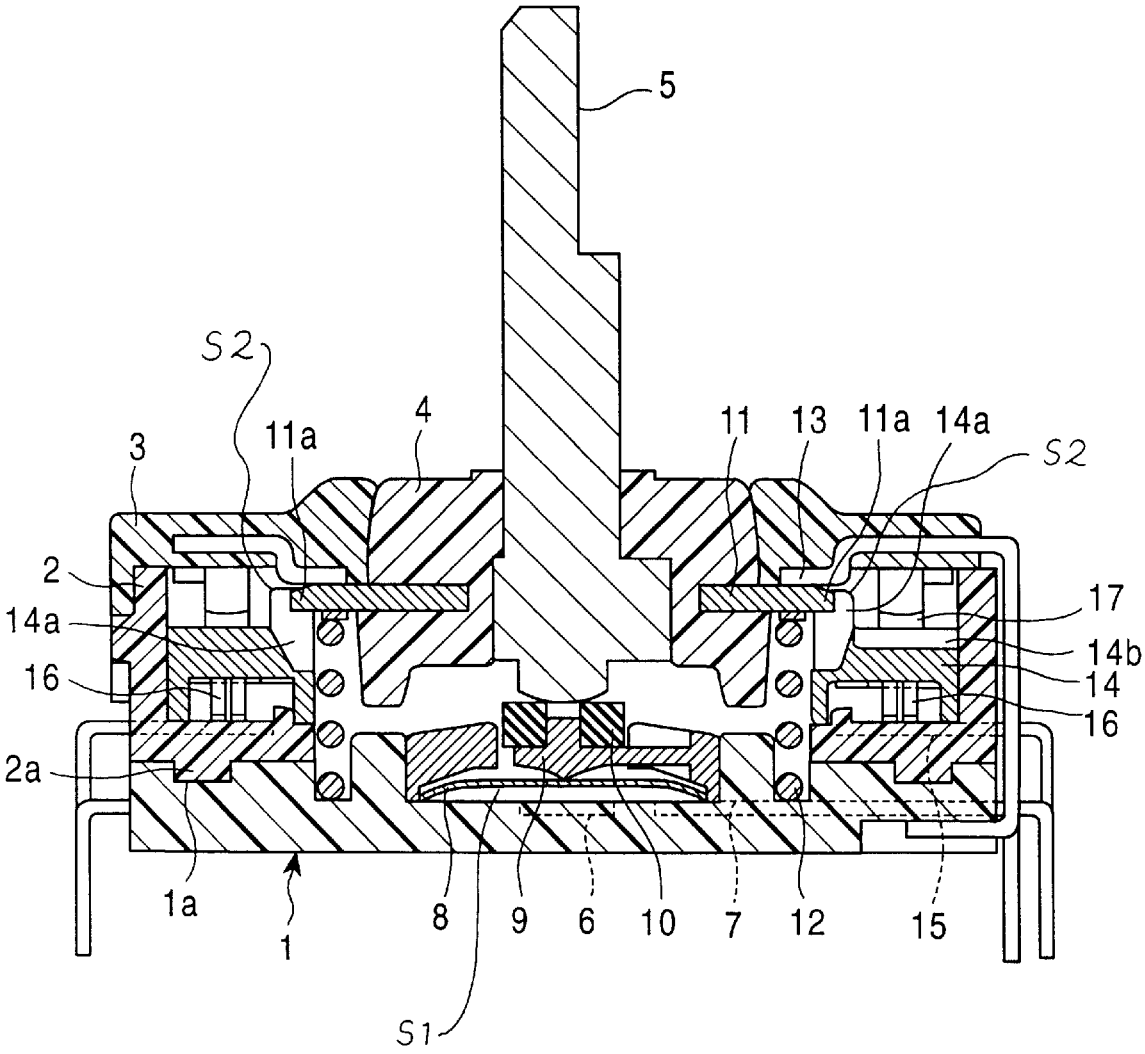
FIG. 1 is a cross-sectional view showing a non-operated state of a multiple-operation electric component according to an embodiment of the present invention.

First, the inner multi-direction switch will be described. The multi-direction switch includes a base 1 made of synthetic resin, and a housing 2 made of synthetic resin is placed on the base 1. The housing 2 forms an outer shell of the rotary switch, and a recess 1*a* of the base 1 and a projection 2*a* of the housing 2 fit together. A cover 3 made of synthetic resin is attached to an upper open end of the housing 2. The cover 3 is placed on the upper end of the opening of the housing 2 so as to cover the opening. As shown in FIG. 1, a projection provided on the outer circumference of the housing 2 is inserted into a cutout provided in the outer edge of the cover 3. A part of a fixed contact 13 (to be described later) integrally held with the housing 2 is bent toward the lower surface of the base 1, whereby the cover 3 is attached to the housing 2. A driver 4 made of synthetic resin is fitted into a center hole of the cover 3. A metallic operating lever 5 is inserted into the driver 4. The driver 4 and the operating lever 5 can be integrally tilted, but they are spline-connected so that they move relative to each other in the axial direction.

Figure 4:
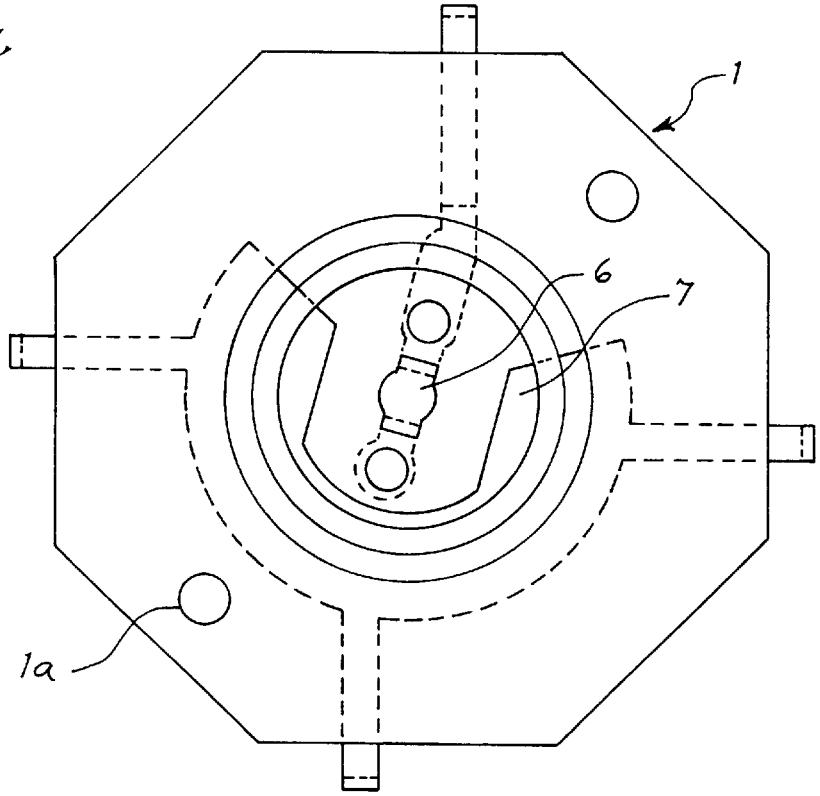
FIG. 4 This is a top plan view for showing the base.
Figure 5:
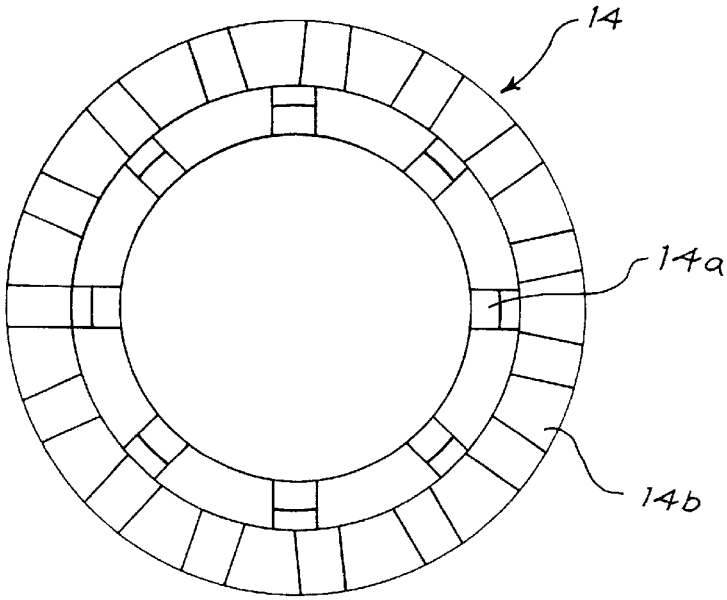
FIG. 5 This is a top plan view for showing the operating ring.
Figure 6:
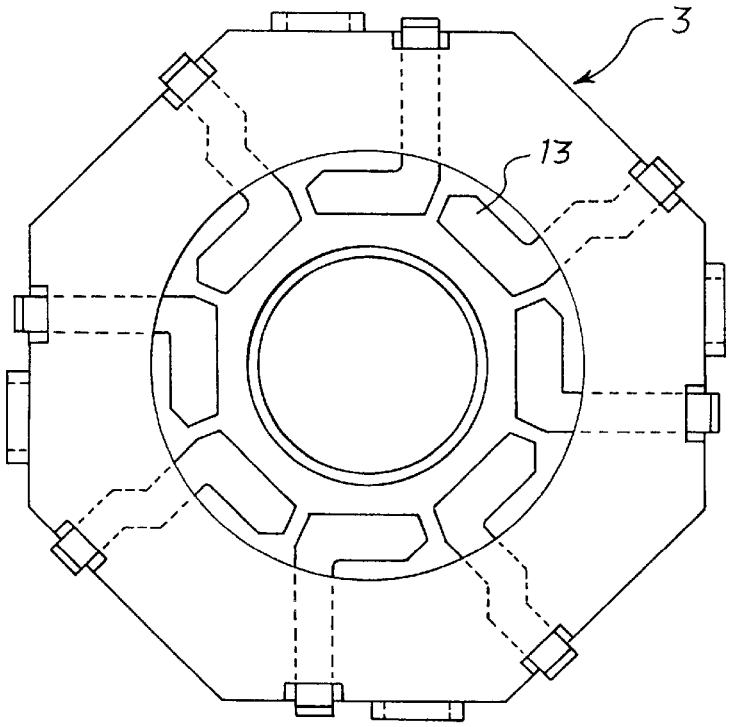
FIG. 6 This is a bottom view for showing the cover.
Figure 7:
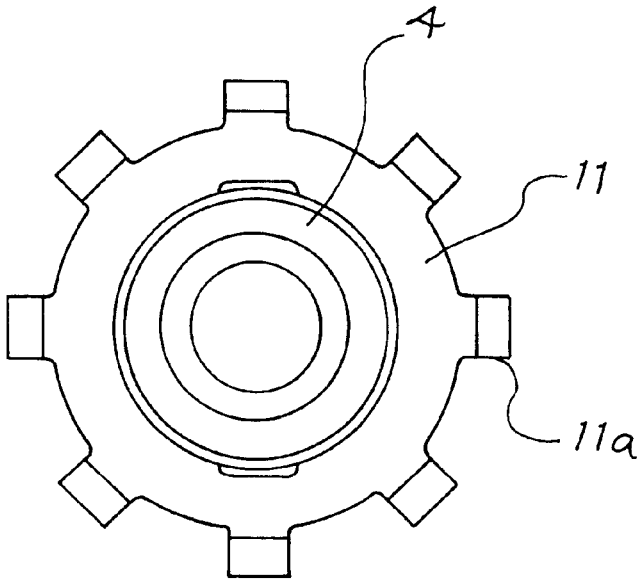
FIG. 7 This is a top plan view for showing a member in which the second movable contact plate is inserted into the driver.
Figure 8:
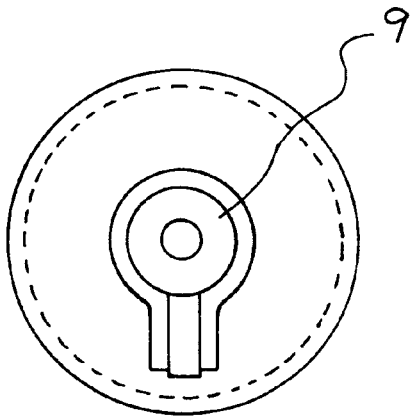
FIG. 8 This is a top plan view for showing the member having the pressing piece arranged therein.

As shown in FIG. 4, a first fixed contact 6 and a common contact 7 are provided on the inner bottom surface of the base 1, and these contacts 6 and 7 extend out of the base 1 as terminals. A first movable contact plate 8, which is brought into contact with and separated from the first fixed contact 6, is placed on the common contact 7, and the first fixed contact 6 and the first movable contact plate 8 constitute one normally-open switch S1. A pressing piece 9 and a rubber buffer 10 are provided between the first movable contact plate 8 and the lower end of the operating lever 5. In addition, a second movable contact plate 11 serving as an engagement member is fixed to the driver 4 by means of an insert-molding or the like, and as shown in FIG. 7, eight projections 11*a* are formed on the second movable contact plate 11 at predetermined intervals. An electrically conductive coil spring 12 is provided between the inner bottom surface of the base 1 and the second movable contact plate 11, and the second movable contact plate 11 is pressed into contact with the lower surface of the cover 3 by a biasing force of the coil spring 12. As shown in FIG. 6, for example, eight second fixed contacts 13 are provided on the lower surface of the cover 3 at predetermined intervals, and these second fixed contacts 13 extend out of the cover 3 as terminals, and are partially bent toward the lower surface of the base 1. Eight normally-closed switches S2 are formed by these second fixed contacts 13 and the second movable contact plate 11.

Figure 3:
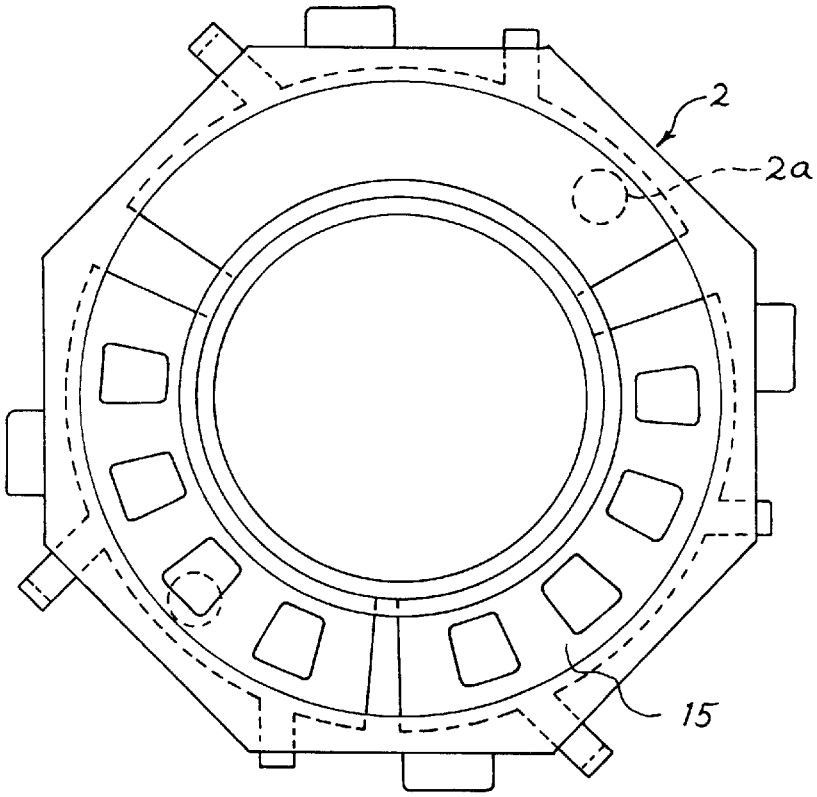
FIG. 3 This is a top plan view for showing the housing.

The outer rotary switch will now be described. The rotary switch includes the housing 2 and an operating ring 14 made of synthetic resin, which is rotatably mounted inside the housing 2. As shown in FIG. 3, a plurality of pattern contacts 15 are formed on the inner bottom surface of the housing 2 at predetermined intervals in the circumferential direction, and these pattern contacts 15 extend out of the housing 2 as terminals. A plurality of, for example, eight cutouts 14*a* are formed at upper portions of the inner peripheral surface of the operating ring 14, and the projections 11*a* of the second movable contact plate 11 are inserted in the cutouts 14*a*, respectively. In addition, a slider 16 is attached to the lower surface of the operating ring 14 so as to slide on the pattern contacts 15. Further, a cam peak 14*b* is formed on the upper surface of the operating ring 14, and a click plate 17 mounted on the lower surface of the cover 3 is engaged with and disengaged from the cam peak 14, whereby a clicking feel is produced.

Figure 2:
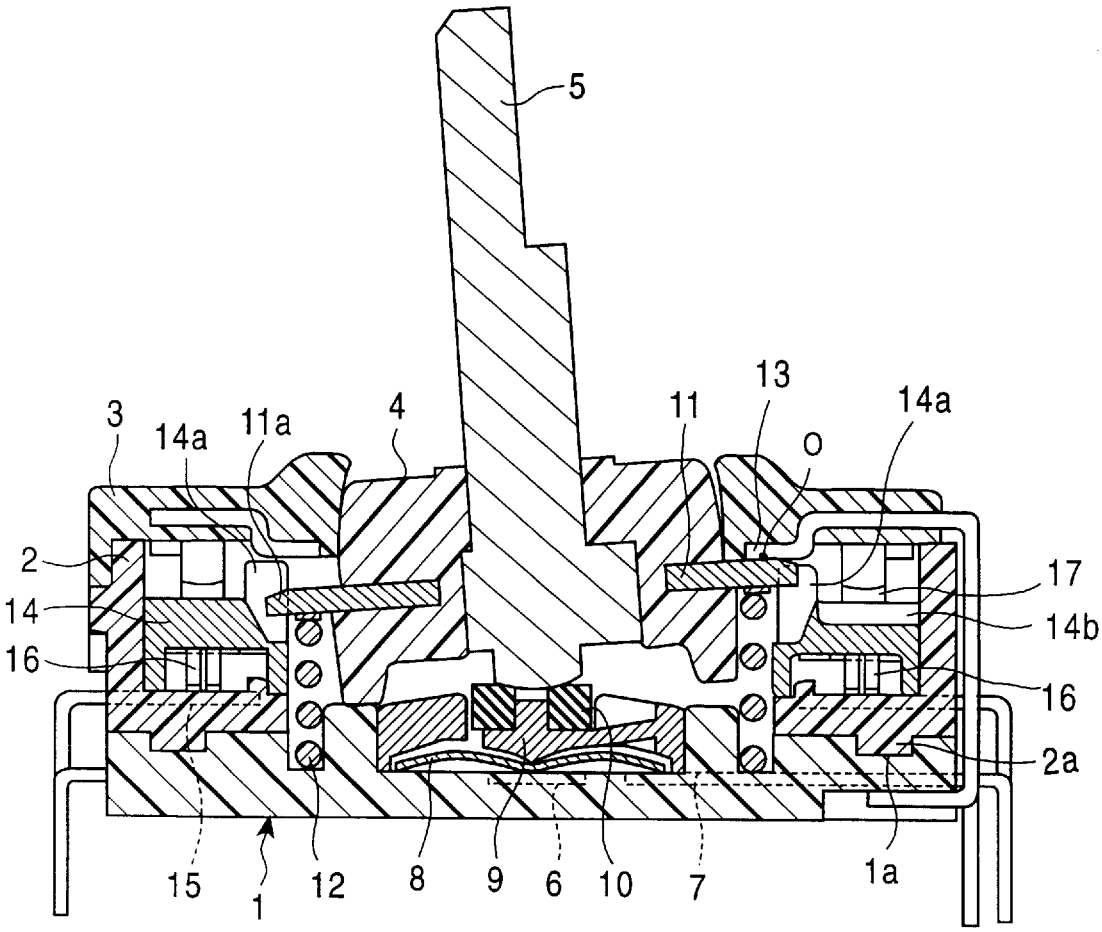
FIG. 2 is a cross-sectional view showing a tilting operation of the multiple-operation electric component.

The operation of the multi-direction switch in the thus constructed multiple-operation electric component will now be described. If the operating lever 5 held in the neutral position of FIG. 1 is tilted in an arbitrary direction, the operating lever 5 is rotated around an abutment portion of the second contact plate 11 with the second fixed contact 13 located on the opposite side to the tilting direction, i.e., a fulcrum 0 shown in FIG. 2, so that only one of the eight normally-closed switches S2 remains in the ON state and all other normally-closed switches S2 are changed to the OFF state. If the operating lever 5 is further tilted in the same direction, the lower end of the operating lever 5 presses the first movable contact plate 8 through the rubber buffer 10 and the pressing piece 9, and the normally-open switch S1 is changed to the ON state when the first movable contact plate 8 comes into contact with the first fixed contact 6. As a result, a conducting path is formed between the normally-open switch S1 and one normally-closed switch S2. Therefore, if, for example, an output signal between the first fixed contact 6 and the second fixed contact 13 is fed to a microcomputer, the tilting direction of the operating lever 5 can be determined according to which fixed second contact 13 outputs the ON signal. In the case where the multi-direction switch is operated, since projections 11*a* of the second movable contact plate 11 rotate within the cutouts 14*a*, the operating ring 14 does not prevent the tilting operation of the operating lever 5.

In addition, if the operating lever 5 is pressed from the neutral position of FIG. 1, the driver 4 and the second movable contact plate 11 are not moved, but only the operating lever 5 is moved directly downward to press the first movable contact plate 8 through the buffer rubber 10 and the pressing piece 9. Conducting paths are formed between the normally-open switch S1 and all the normally-closed switches S2 when the first movable contact plate 8 comes into contact with the first fixed contact 6, so that the microcomputer can detect pushing of the operating lever 5 on the basis of the eight ON signals from the respective second fixed contacts 13.

The operation of the rotary switch will now be described. If the operating lever 5 held in the neutral position of FIG. 1 is rotated in either the clockwise or counter clockwise direction, the operating lever 5, the driver 4 and the second movable contact plate 11 are integrally rotated and the rotation is transmitted to the operating ring 14 through the engagement portions of the projections 11*a* with the cutouts 14*a*. Thus, the operating ring 14 is rotated in association with the operating lever 5. This brings the click plate 17 into engagement with and disengagement from the cam peak 14*b*, whereby a clicking feel is produced, and a slider 16 slides on the pattern contacts 15 to come into contact therewith and separate therefrom. Therefore, an alternating ON/OFF signal responsive to the amount of rotation of the operating lever 14 (i.e., the amount of rotation of the operating lever 5) is output.

Incidentally, the inner multi-direction switch may have any structure so long as it generate an output signal in response to tilting of the operating lever. In addition, a rotary volume control having an operating ring whose rotation is limited within 360° may be used in place of the rotary switch of the above-described embodiment. In this case, a stopper for controlling the rotation angle of the operating ring may be provided on a fixed member, such as the base or the like.

What is claimed is:

1. A multiple-operation electric component comprising:

a multi-direction switch having an operating lever;

a rotary electric component generating a signal in response to rotation of the operating lever;

a driver inclined by the operating lever;

a cover having a through-hole through which the operating lever is inserted and having a plurality of fixed contacts arranged around the through-hole;

a coil spring for biasing the driver towards the cover; and a movable contact arranged to protrude at an outer circumference of the driver, and to oppose the plurality of fixed contacts, the movable contact being pressed towards the plurality of fixed contacts by the coil, the movable contact being inclined using a contact position of the movable contact located on an opposing side to an inclining direction of the operating lever and one of the fixed contacts as a fulcrum point when the operating lever and the driver are inclined, and the movable contact being separated from the plurality of fixed contacts except one of the fixed contacts at the contacted position;

wherein an outer circumferential edge of the movable contact is provided with an engagement part; and wherein the rotary electric component has an operating ring having a plurality of cut-outs engageable with a plurality of projections formed in the outer circumferential edge of the movable contact of the multi-direction switch so the rotary electric component outputs a signal when the operating ring is rotated.

* * * * *